US010847912B2

(12) United States Patent
Kunze et al.

(10) Patent No.: US 10,847,912 B2
(45) Date of Patent: Nov. 24, 2020

(54) BROADBAND SOCKET CONNECTOR, BROADBAND PLUG CONNECTOR, AND SYSTEM THEREOF

(71) Applicant: Rohde & Schwarz GmbH & Co. KG, Munich (DE)

(72) Inventors: Alexander Kunze, Munich (DE); Alexander Stuka, Deggendorf (DE)

(73) Assignee: ROHDE & SCHWARZ GMBH & CO. KG, Munich (DE)

( * ) Notice: Subject to any disclaimer, the term of this patent is extended or adjusted under 35 U.S.C. 154(b) by 0 days.

(21) Appl. No.: 15/925,032

(22) Filed: Mar. 19, 2018

(65) Prior Publication Data

US 2019/0288424 A1 Sep. 19, 2019

(51) Int. Cl.

| | |
|---|---|
| ***H01R 12/83*** | (2011.01) |
| ***H01R 12/81*** | (2011.01) |
| ***H01R 13/64*** | (2006.01) |
| ***H01R 4/48*** | (2006.01) |
| *H01R 13/66* | (2006.01) |
| *H01R 12/77* | (2011.01) |
| *H01R 12/79* | (2011.01) |
| *H01R 13/02* | (2006.01) |
| *H01R 12/72* | (2011.01) |
| *H01R 11/24* | (2006.01) |
| *H01R 12/59* | (2011.01) |

(52) U.S. Cl.

CPC ..... *H01R 12/83* (2013.01); *H01R 4/48* (2013.01); *H01R 12/81* (2013.01); *H01R 13/64* (2013.01); *H01R 11/24* (2013.01); *H01R 12/59* (2013.01); *H01R 12/721* (2013.01); *H01R 12/774* (2013.01); *H01R 12/79* (2013.01); *H01R 13/025* (2013.01); *H01R 13/6658* (2013.01)

(58) Field of Classification Search

CPC ..... H01R 11/24; H01R 4/48; H01R 12/83

See application file for complete search history.

(56) References Cited

U.S. PATENT DOCUMENTS

| | | | | | |
|---|---|---|---|---|---|
| 4,952,177 | A * | 8/1990 | Drake | A61B 18/16 | 439/838 |
| 5,047,895 | A * | 9/1991 | Sasaki | H05K 1/118 | 361/749 |
| 5,123,852 | A * | 6/1992 | Gillett | H01R 12/853 | 439/496 |
| 5,791,944 | A * | 8/1998 | Grant | A61B 5/0416 | 439/822 |
| 6,164,979 | A * | 12/2000 | Gillette | H01R 12/79 | 439/67 |

(Continued)

FOREIGN PATENT DOCUMENTS

| | | | |
|---|---|---|---|
| DE | 202012001645 | U1 | 5/2013 |
| WO | 2013120580 | A1 | 8/2013 |

*Primary Examiner* — Tho D Ta

(74) *Attorney, Agent, or Firm* — Ditthavong & Steiner P.C.

(57) ABSTRACT

A broadband connector system is provided. Said broadband connector system comprises a broadband socket connector comprising a socket strip conductor element comprising a socket lateral dimension, and a broadband plug connector comprising a plug strip conductor element comprising a plug lateral dimension. In this context, the broadband socket connector is connectable to the broadband plug connector, wherein the socket lateral dimension is greater or equal to the plug lateral dimension.

18 Claims, 6 Drawing Sheets

(56) References Cited

U.S. PATENT DOCUMENTS

| | | | | |
|---|---|---|---|---|
| 7,351,070 | B2 * | 4/2008 | Hirai | H05K 3/365 439/157 |
| 7,361,059 | B2 * | 4/2008 | Harkabi | H01R 27/00 439/218 |
| 7,440,287 | B1 * | 10/2008 | Ni | H01R 27/00 174/50.51 |
| 7,830,114 | B2 * | 11/2010 | Reed | H01F 38/14 320/108 |
| 2008/0207035 | A1 * | 8/2008 | Jahn | H01R 12/585 439/329 |
| 2015/0024619 | A1 * | 1/2015 | Thies | H01R 12/81 439/329 |

* cited by examiner

BROADBAND SOCKET CONNECTOR, BROADBAND PLUG CONNECTOR, AND SYSTEM THEREOF

TECHNICAL FIELD

The invention relates to a broadband socket connector, a broadband plug connector, and a broadband connector system especially comprising said socket connector and plug connector.

BACKGROUND ART

Generally, in times of an increasing number of applications comprising electrical circuitry providing a multitude of broadband signals, there is a growing need of a broadband connector and a broadband connector system for connecting a measurement device in an efficient and error-insensitive manner especially in order to verify the proper functioning of said applications.

DE 20 2012 001 645 U1 relates in general to a device for contacting a circuit board. However, said device does not provide a cost-effective tolerance compensation for ensuring an efficient and error-insensitive broadband connection to the circuit board.

Accordingly, there is a need to provide a broadband connector, especially a broadband socket connector and a broadband plug connector, and a broadband connector system for contacting a circuit board in an efficient and error-insensitive manner with special respect to broadband signals, thereby cost-effectively compensating tolerances regarding the connectors.

SUMMARY OF THE INVENTION

According to a first aspect of the invention, a broadband socket connector being connectable to a broadband plug connector comprising a plug strip conductor element comprising a plug lateral dimension is provided. In this context, said broadband socket connector comprises a socket strip conductor element comprising a socket lateral dimension, wherein the socket lateral dimension is greater or equal to the plug lateral dimension. Advantageously, with the aid of the geometry fulfilling said condition, tolerances can be compensated in a cost-effective manner.

According to a first preferred implementation form of the first aspect, the socket lateral dimension is greater or equal to 0.8 times the plug lateral dimension, preferably 1.1 times the plug lateral dimension, more preferably 1.2 the plug lateral dimension, most preferably 1.4 the plug lateral dimension. Advantageously, error-insensitivity can further be increased. Further advantageously, in this manner, it is allowed for an overlap of the socket strip conductor element and the plug strip conductor element especially to ensure an electrical connection.

According to a further preferred implementation form of the first aspect, the broadband socket connector comprises a reception section mating with a dimension of the broadband plug connector, wherein the reception section is configured to releasable receive the plug strip conductor element. Advantageously, the broadband plug connector can accurately be guided with respect to the broadband socket connector.

According to a further preferred implementation form of the first aspect, the reception section of the broadband socket connector is surrounded by an intake body forming a stopper for the broadband plug connector. Advantageously, the broadband plug connector can be positioned easily.

According to a further preferred implementation form of the first aspect, the broadband socket connector is formed clamp-like and configured to clamp the broadband plug connector. Advantageously, a proper electrical connection can be ensured especially by pressing the socket strip conductor element against the plug strip conductor element.

According to a further preferred implementation form of the first aspect, the broadband socket connector comprises at least one additional conductor element configured to form a microstrip arrangement or a coplanar arrangement. Advantageously, accuracy can be increased.

According to a second aspect of the invention, a broadband plug connector being connectable to a broadband socket connector comprising a socket strip conductor element comprising a socket lateral dimension is provided. In this context, the broadband plug connector comprises a plug strip conductor element comprising a plug lateral dimension, wherein the socket lateral dimension is greater or equal to the socket lateral dimension. Advantageously, with the aid of the geometry fulfilling said condition, tolerances can be compensated in a cost-effective manner.

According to a first preferred implementation form of the second aspect, the socket lateral dimension is greater or equal to 0.8 times the plug lateral dimension, preferably 1.1 times the plug lateral dimension, more preferably 1.2 the plug lateral dimension, most preferably 1.4 the plug lateral dimension. Advantageously, error-insensitivity can further be increased. Further advantageously, in this manner, it is allowed for an overlap of the socket strip conductor element and the plug strip conductor element especially to ensure an electrical connection.

According to a further preferred implementation form of the second aspect, the broadband plug connector comprises a flexible or bendable printed circuit board. Advantageously, the broadband plug connector allows for contacting terminal pads or other points of contact being hard-to-reach.

According to a further preferred implementation form of the second aspect, the broadband plug connector comprises at least one solder port electrically connected with the plug strip conductor element. Advantageously, this allows for connecting a device under test.

According to a third aspect of the invention, a broadband connector system is provided. Said broadband connector system comprises a broadband socket connector comprising a socket strip conductor element comprising a socket lateral dimension, and a broadband plug connector comprising a plug strip conductor element comprising a plug lateral dimension. In this context, the broadband socket connector is connectable to the broadband plug connector, wherein the socket lateral dimension is greater or equal to the plug lateral dimension. Advantageously, with the aid of the geometry fulfilling said condition, tolerances can be compensated in a cost-effective manner.

According to a first preferred implementation form of the third aspect, the socket lateral dimension is greater or equal to 0.8 times the plug lateral dimension, preferably 1.1 times the plug lateral dimension, more preferably 1.2 the plug lateral dimension, most preferably 1.4 the plug lateral dimension. Advantageously, error-insensitivity can further be increased. Further advantageously, in this manner, it is allowed for an overlap of the socket strip conductor element and the plug strip conductor element especially to ensure an electrical connection.

According to a further preferred implementation form of the third aspect, the broadband socket connector comprises a reception section mating with a dimension of the broadband plug connector, wherein the reception section is configured to releasable receive the plug strip conductor element. Advantageously, the broadband plug connector can accurately be guided with respect to the broadband socket connector.

According to a further preferred implementation form of the third aspect, the reception section of the broadband socket connector is surrounded by an intake body forming a stopper for the broadband plug connector. Advantageously, the broadband plug connector can be positioned easily.

According to a further preferred implementation form of the third aspect, the broadband socket connector is formed clamp-like and configured to clamp the broadband plug connector. Advantageously, a proper electrical connection can be ensured especially by pressing the socket strip conductor element against the plug strip conductor element.

According to a further preferred implementation form of the third aspect, the broadband socket connector comprises at least one additional conductor element configured to form a microstrip arrangement or a coplanar arrangement. Advantageously, accuracy can be increased.

According to a further preferred implementation form of the third aspect, the broadband plug connector comprises a flexible or bendable printed circuit board. Advantageously, the broadband plug connector allows for contacting terminal pads or other points of contact being hard-to-reach.

According to a further preferred implementation form of the third aspect, the broadband plug connector comprises at least one solder port electrically connected with the plug strip conductor element. Advantageously, this allows for connecting a device under test.

BRIEF DESCRIPTION OF THE DRAWINGS

Exemplary embodiments of the invention are now further explained with respect to the drawings by way of example only, and not for limitation. In the drawings.

DETAILED DESCRIPTION OF THE PREFERRED EMBODIMENTS

Figure 1:
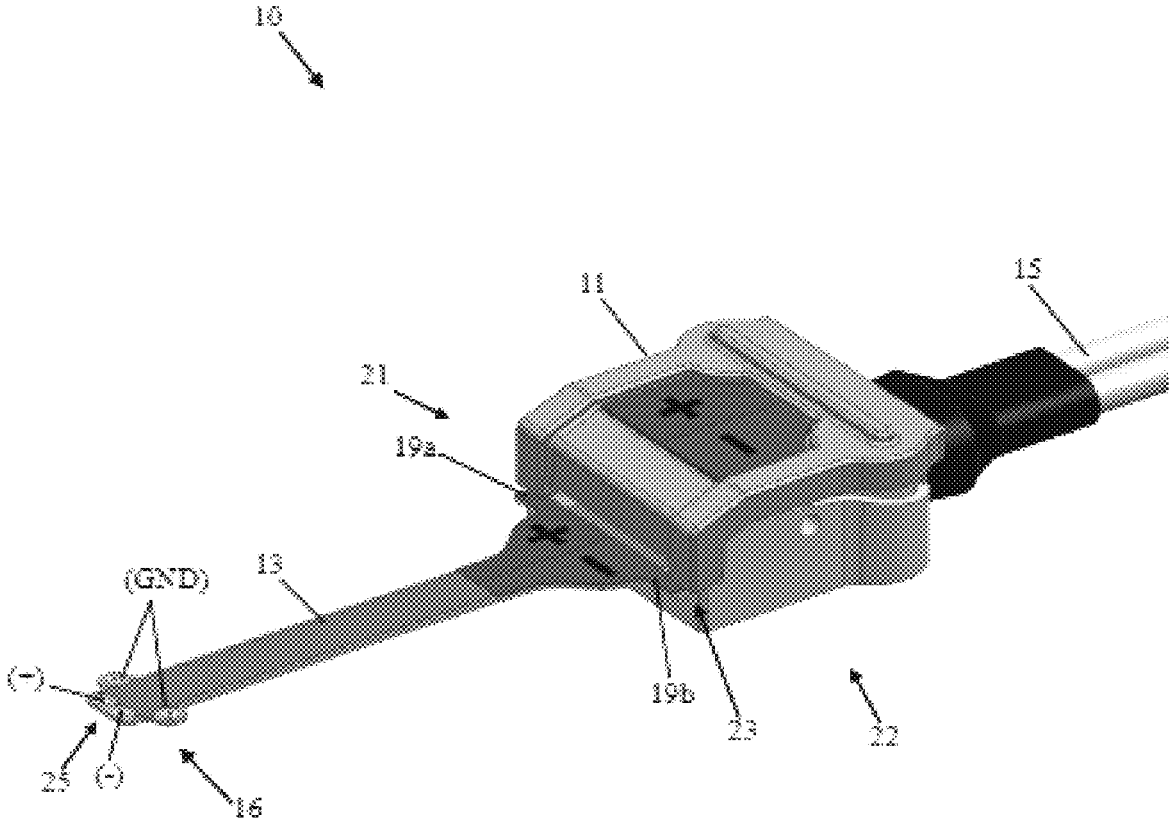
FIG. 1 shows a three-dimensional view of an exemplary embodiment of the third aspect of the invention.

Firstly, FIG. 1 illustrates a three-dimensional view of an exemplary embodiment of a broadband connector system 10 according to the third aspect of the invention. Said broadband connector system 10 especially comprises a broadband socket connector 11 according to the first aspect of the invention, and a broadband plug connector 13 according to the second aspect of the invention. The area of the broadband socket connector 11, which receives the broadband plug connector 13, is the reception section 21.

Whereas the broadband socket connector 11 comprises at least one radio frequency cable, exemplarily two radio frequency cables, preferably in the form of at least one coaxial cable, the broadband plug connector 13 comprises a contacting area 16 configured to be connected with a device under test. The intake body 22 is a type of housing of the broadband socket connector 11.

For instance, as it can be seen from FIG. 1, said contacting area 16 of the broadband plug connector 13 comprises at least one port, exemplarily two ports, for connecting ground (GND), at least one port, exemplarily one port, for connecting a positive signal (+), and at least one port, exemplarily one port, for connecting a negative signal (−). Said positive signal (+) and negative signal (−) may preferably be signal portions of a differential signal. The port for connecting the positive signal (+) or the port connecting the negative signal (−) of the broadband plug connector 13 can be considered as a solder port 25.

Furthermore, also with respect to the broadband plug connector 13, said plug connector 13 comprises two stopping areas 19*a*, 19*b* being configured to stop the broadband plug connector 13 at the correct position with respect to the broadband socket connector 11. Portions of the broadband socket connector 11, which correspond to the stopping areas 19*a*, 19*b* of the broadband plug connector 13, include the stopper 23. In this context, it is noted that the broadband plug connector 13 is especially embodied as a disposable tip board.

Figure 2A:
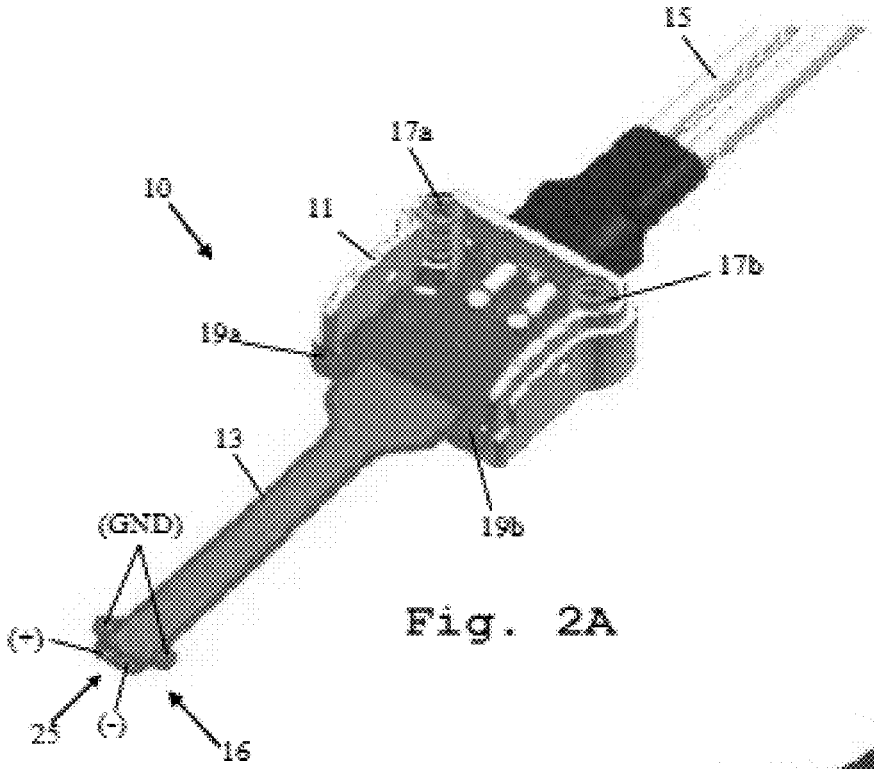
FIG. 2A shows an inside view of the exemplary embodiment of FIG. 1.

Now, with respect to the broadband socket connector 11, FIG. 2A depicts an inside view thereof. As it can be seen, the broadband socket connector 11 comprises at least one spring element, exemplarily two spring elements 17*a*, 17*b*.

With the aid of these spring elements 17*a*, 17*b*, the broadband socket connector 11 is formed clamp-like and configured to clamp the broadband plug connector 13.

Figure 3A:
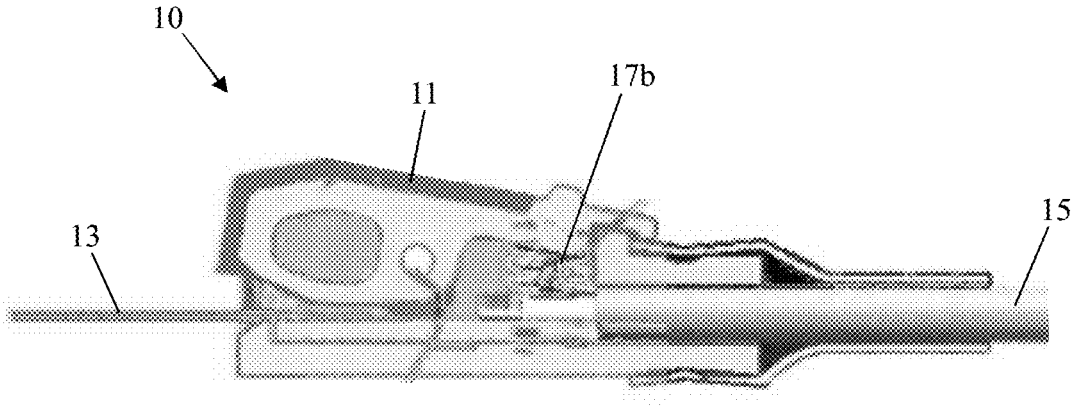
FIG. 3A shows a side section view of the exemplary embodiment of FIG. 1 with released plug connector.
Figure 3B:
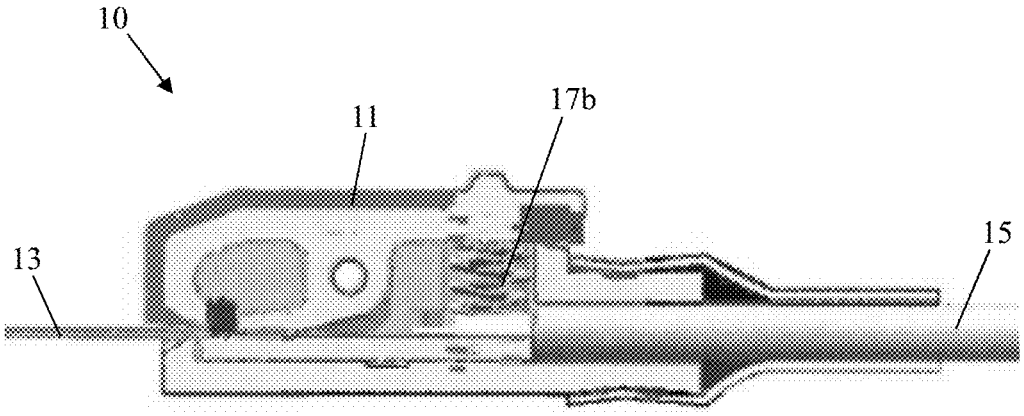
FIG. 3B shows a side section view of the exemplary embodiment of FIG. 1 with released plug connector.

In this context, FIG. 3A illustrates that compressing the spring elements of the broadband socket connector 11 leads to a release of the broadband plug connector 13, whereas, in accordance with FIG. 3B, not manually compressing the spring elements leads to a fixation of the broadband plug connector 13.

Figure 2B:
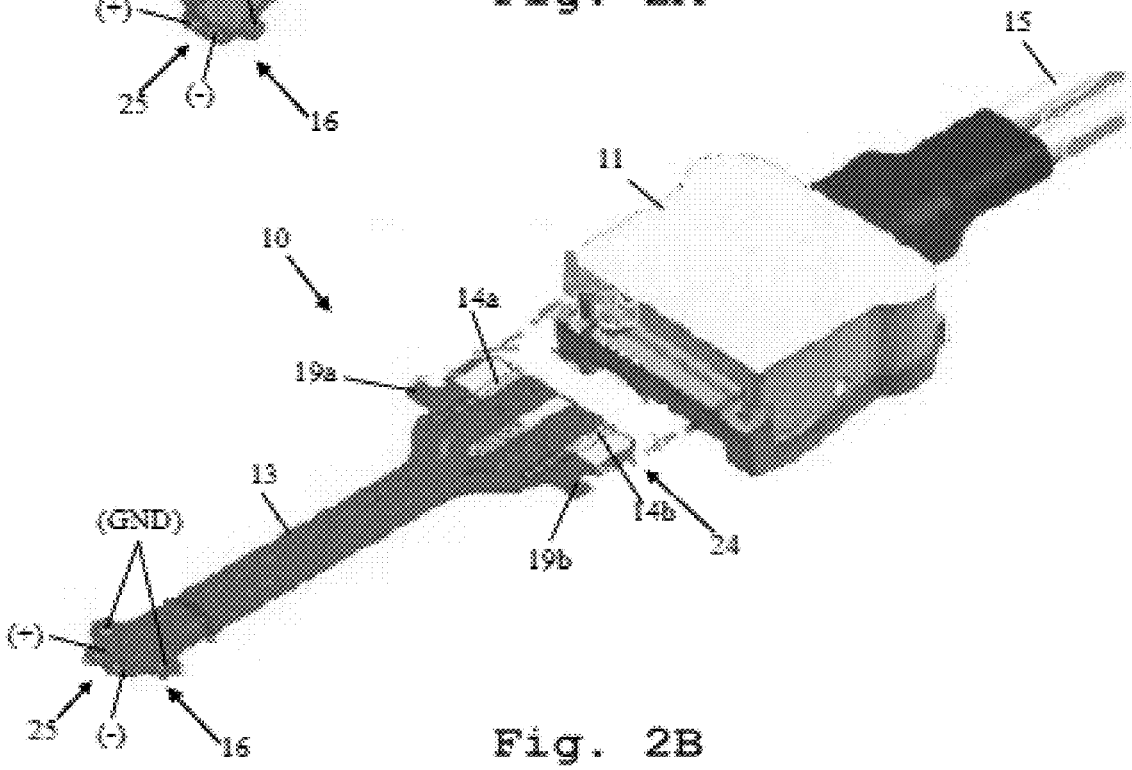
FIG. 2B shows a further view of the exemplary embodiment of FIG. 1.

In addition to this, according to FIG. 2B depicting a further view of the inventive broadband connector system 11, it can be seen that the broadband plug connector 13 comprises at least one plug strip conductor element, exemplarily two plug strip conductor elements 14*a*, 14*b*. For instance, conductor element 14*a* can be referenced as one plug strip conductor element; and conductor element 14*b* can be referenced as an additional conductor element 24.

Figure 4:
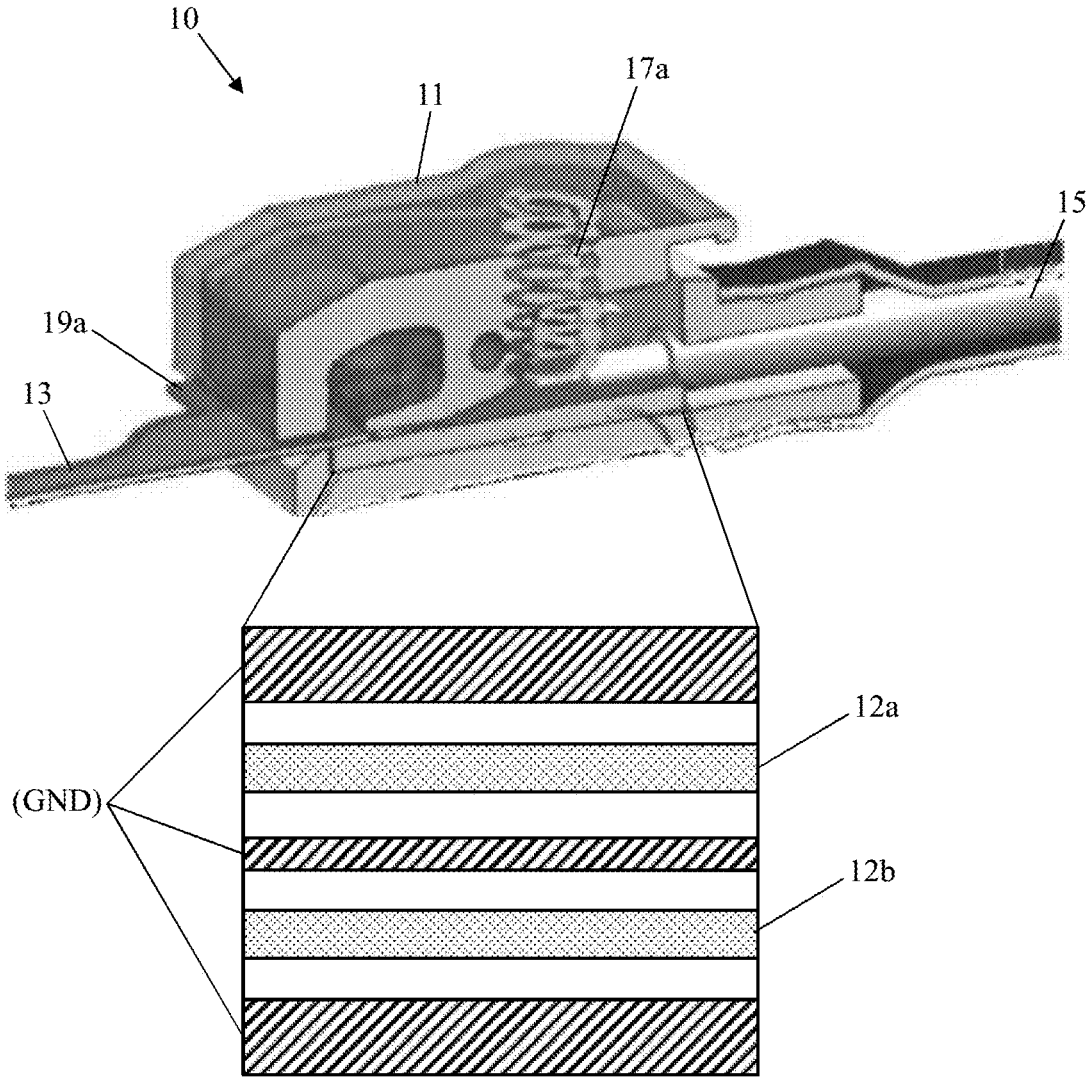
FIG. 4 shows a three-dimensional section view of the exemplary embodiment of FIG. 1 with conductor elements of the socket connector.

In an analogous manner, as it can be seen from FIG. 4, the broadband socket connector 11 comprises at least one socket strip conductor element, exemplarily two socket strip conductor elements 12*a*, 12*b*. Additionally, FIG. 4 also depicts some ground planes (GND).

Figure 5:
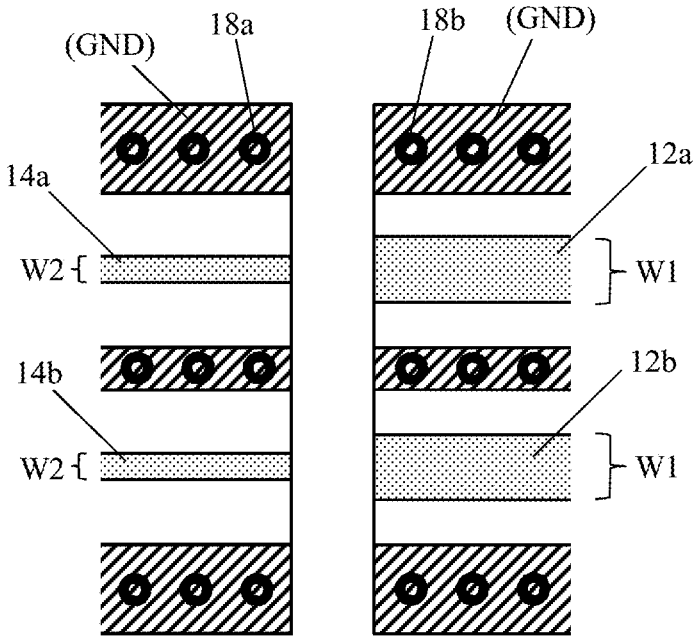
FIG. 5 shows an exemplary embodiment of contacting of the conductor elements of the socket and the plug connector.

Moreover, FIG. 5 exemplarily shows contacting of said strip conductor elements 12*a*, 12*b*, 14*a*, 14*b* of the broadband socket connector 11 and the broadband plug connector 13. In this exemplary case, all ground planes (GND) are depicted as hatched areas. Said ground planes additionally comprise vias, two of which are exemplarily marked with reference signs 18*a*, 18*b*, for contacting ground on the opposite side of the respective board of the broadband socket connector 11 or the broadband plug connector 13, respectively.

As it can further be seen from FIG. 5, each of the socket strip conductor elements 12*a*, 12*b* of the broadband socket connector 11 comprises a socket lateral dimension W1, whereas each of the plug strip conductor elements 14, 14*b* of the broadband plug connector 13 comprises a plug lateral dimension W2. In this context, the socket lateral dimension W1 is greater than the plug lateral dimension. Alternatively, it is particularly advantageous if the socket lateral dimension W1 is greater or equal to the plug lateral dimension W2.

As a further alternative, the socket lateral dimension W1 may be greater or equal to 0.8 times the plug lateral dimension W2, preferably 1.1 times the plug lateral dimension W2, more preferably 1.2 the plug lateral dimension W2, most preferably 1.4 the plug lateral dimension W2.

Figure 6:
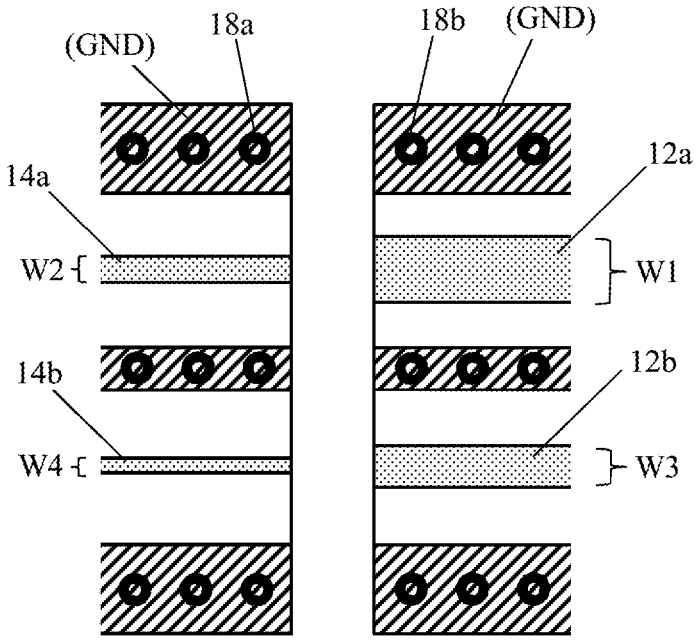
FIG. 6 shows an alternative exemplary embodiment of contacting of the conductor elements of the socket and the plug connector.

Finally, FIG. 6 depicts an alternative exemplary embodiment contacting of said strip conductor elements 12*a*, 12*b*, 14*a*, 14*b* of the broadband socket connector 11 and the broadband plug connector 13.

In this exemplary case, the above-mentioned advantageous conditions with respect to the lateral dimension of the socket strip conductor elements 12*a*, 12*b*, and the plug strip conductor elements 14*a*, 14*b* have been applied pairwise.

As it can be seen from FIG. 6, a first socket lateral dimension W1 of a first socket strip conductor element 12*a* of the broadband socket connector 11 is greater or equal to, exemplarily greater than, a first plug lateral dimension W2 of a first plug strip conductor element 14*a* of the broadband plug connector 13.

As an alternative, the first socket lateral dimension W1 may be greater or equal to 0.8 times the first plug lateral dimension W2, preferably 1.1 times the first plug lateral dimension W2, more preferably 1.2 the first plug lateral dimension W2, most preferably 1.4 the first plug lateral dimension W2.

By analogy with the explanations above, a second socket lateral dimension W3 of a second socket strip conductor element 12*b* of the broadband socket connector 11 is greater or equal to, exemplarily greater than, a second plug lateral dimension W4 of a second plug strip conductor element 14*b* of the broadband plug connector 13.

Alternatively, as already mentioned above, the second socket lateral dimension W3 may be greater or equal to 0.8 times the second plug lateral dimension W4, preferably 1.1 times the second plug lateral dimension W4, more preferably 1.2 the second plug lateral dimension W4, most preferably 1.4 the second plug lateral dimension W4.

While various embodiments of the present invention have been described above, it should be understood that they have been presented by way of example only, and not limitation. Numerous changes to the disclosed embodiments can be made in accordance with the disclosure herein without departing from the spirit or scope of the invention. Thus, the breadth and scope of the present invention should not be limited by any of the above described embodiments. Rather, the scope of the invention should be defined in accordance with the following claims and their equivalents.

Although the invention has been illustrated and described with respect to one or more implementations, equivalent alterations and modifications will occur to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application.

What is claimed is:

1. A broadband socket connector being connectable to a broadband plug connector comprising a plug strip conductor element comprising a plug lateral dimension, wherein the broadband socket connector comprises a socket strip conductor element comprising a socket lateral dimension, wherein the socket lateral dimension is greater or equal to 1.1 times the plug lateral dimension, wherein the broadband socket connector comprises at least one spring element, the at least one spring element being configured to release the broadband plug connector when compressed, and to fix the broadband plug connector when not manually compressed, wherein the broadband plug connector is configured as a disposable tip board, and wherein a connecting area of the broadband plug connector comprises at least one port for connecting a ground, at least one port for a positive signal and at least one port for a negative signal.

2. The broadband socket connector according to claim 1, wherein the socket lateral dimension is greater or equal to 1.2 times the plug lateral dimension or 1.4 times the plug lateral dimension.

3. The broadband socket connector according to claim 1, wherein the broadband socket connector comprises a reception section mating with a dimension of the broadband plug connector, wherein the reception section is configured to releasable receive the plug strip conductor element.

4. The broadband socket connector according to claim 3, wherein the reception section of the broadband socket connector is surrounded by an intake body forming a stopper for the broadband plug connector.

5. The broadband socket connector according to claim 1, wherein the broadband socket connector is formed clamp-like and configured to clamp the broadband plug connector.

6. The broadband socket connector according to claim 1, wherein the broadband socket connector comprises at least one additional conductor element configured to form a microstrip arrangement or a coplanar arrangement.

7. A broadband plug connector being connectable to a broadband socket connector comprising:

a socket strip conductor element comprising a socket lateral dimension, wherein the broadband plug connector comprises a plug strip conductor element comprising a plug lateral dimension, wherein the socket lateral dimension is greater or equal to 1.1 times the plug lateral dimension, wherein the broadband plug connector is fixed and released with the aid of at least one spring element comprised in the broadband socket connector, the at least one spring element being configured to release the broadband plug connector when compressed, and to fix the broadband plug connector when not manually compressed, wherein the broadband plug connector is configured as a disposable tip board, and wherein a connecting area of the broadband plug connector comprises at least one port for connecting a ground, at least one port for a positive signal and at least one port for a negative signal.

8. The broadband plug connector according to claim 7, wherein the socket lateral dimension is greater or equal to 1.2 times the plug lateral dimension or 1.4 times the plug lateral dimension.

9. The broadband plug connector according to claim 7, wherein the broadband plug connector comprises a flexible or bendable printed circuit board.

10. The broadband plug connector according to claim 7, wherein the broadband plug connector comprises the at least one solder port electrically connected with the plug strip conductor element.

11. A broadband connector system comprising:

a broadband socket connector comprising a socket strip conductor element comprising a socket lateral dimension, a broadband plug connector comprising a plug strip conductor element comprising a plug lateral dimension, wherein the broadband socket connector is connectable to the broadband plug connector, wherein the socket lateral dimension is greater or equal to 1.1 times the plug lateral dimension, wherein the broadband socket connector comprises at least one spring element, the at least one spring element being configured to release the broadband plug connector when compressed, and to fix the broadband plug connector when not manually compressed, wherein the broadband plug connector is configured as a disposable tip board, and wherein a connecting area of the broadband plug connector comprises at least one port for connecting a ground, at least one port for a positive signal and at least one port for a negative signal.

12. The broadband connector system according to claim 11, wherein the socket lateral dimension is greater or equal to 1.2 times the plug lateral dimension or 1.4 times the plug lateral dimension.

13. The broadband connector system according to claim 11, wherein the broadband socket connector comprises a reception section mating with a dimension of the broadband plug connector, wherein the reception section is configured to releasable receive the plug strip conductor element.

14. The broadband connector system according to claim 13, wherein the reception section of the broadband socket connector is surrounded by an intake body forming a stopper for the broadband plug connector.

15. The broadband connector system according to claim 11, wherein the broadband socket connector is formed clamp-like and configured to clamp the broadband plug connector.

16. The broadband connector system according to claim 11, wherein the broadband socket connector comprises at least one additional conductor element configured to form a microstrip arrangement or a coplanar arrangement.

17. The broadband connector system according to claim 11, wherein the broadband plug connector comprises a flexible or bendable printed circuit board.

18. The broadband connector system according to claim 11, wherein the broadband plug connector comprises the at least one solder port electrically connected with the plug strip conductor element.

* * * * *